US006123219A

United States Patent [19]

Cornell et al.

[11] Patent Number: 6,123,219

[45] Date of Patent: Sep. 26, 2000

[54] STRAW AND DISPENSING DEVICE FOR USE IN A BEVERAGE CONTAINER

[75] Inventors: Stephen W. Cornell, Naperville, Ill.; Peter F. Murphy, Grosse Pointe, Mich.; Jon Taylor, Chicago, Ill.

[73] Assignee: The PopStraw Company, LLC, Roseville, Mich.

[21] Appl. No.: 09/337,772

[22] Filed: Jun. 22, 1999

Related U.S. Application Data

[62] Division of application No. 08/992,836, Dec. 17, 1997, Pat. No. 5,975,340.

[51] Int. Cl.[7] ..... A47G 21/18

[52] U.S. Cl. ..... 220/705; 239/33

[58] Field of Search ..... 239/33; 220/705, 220/706, 708, 709, 710

[56] References Cited

U.S. PATENT DOCUMENTS

| | | | |
|---|---|---|---|
| 3,326,695 | 6/1967 | Neuhauser | 239/33 |
| 3,409,224 | 11/1968 | Harp et al. | 239/33 |
| 3,438,578 | 4/1969 | Peterson et al. | 239/33 |
| 4,228,913 | 10/1980 | Mack et al. | 220/710 |
| 4,582,213 | 4/1986 | Park et al. | 220/707 |
| 4,709,829 | 12/1987 | Johnson et al. | 220/706 |
| 5,172,827 | 12/1992 | Chang et al. | 220/707 |
| 5,727,734 | 3/1998 | Su | 239/33 |

*Primary Examiner*—Stephen Castellano
*Attorney, Agent, or Firm*—Harness, Dickey & Pierce, P.L.C.

[57] ABSTRACT

A straw assembly disposed within a beverage container and adapted for use with various positioning mechanisms is disclosed. The straw assembly includes a plurality of structural features formed therein for appropriately locating the positioning mechanism. Additionally, a positioning mechanism slidably locatable along the axial length of the straw is disclosed which appropriately positions the straw in an opening of the container. The straw assembly may be fabricated from a photo-degradable material which expedites the photodegradation of the straw assembly when exposed to sunlight.

19 Claims, 6 Drawing Sheets

STRAW AND DISPENSING DEVICE FOR USE IN A BEVERAGE CONTAINER

This is a division of U.S. patent application No. 08/992,836, filed Dec. 17, 1997, now U.S. Pat No. 5,975,340.

BACKGROUND AND SUMMARY OF THE INVENTION

The present invention relates to beverage containers having a self-contained straw and, more particularly, to a straw and a method of making a straw having features particularly adapted for use within the aforementioned container. Various designs have been proposed in the past art for placing a straw within a beverage container can that becomes accessible to the user when the beverage container is opened. An exemplary approach is disclosed in U.S. Pat. No. 5,547,103 which is assigned to the assignee of the present invention and which describes a beverage can containing a straw dispensing mechanism that relies upon user manipulation of the container and the forces of gravity to bring the straw into alignment with the opening in the lid. More particularly, the user merely tilts the container, preferably prior to opening, to cause the mechanism within the container to bring the straw substantially into alignment with the tab. Once the can is opened, further minor manipulation of the can may be necessary to complete the alignment of the straw within the orifice.

Another exemplary approach is disclosed in U.S. Pat. No. 5,080,247 which is assigned to the assignee of the present invention and which describes a beverage container having a positioning mechanism disposed therein which supports a straw substantially parallel to the longitudinal axis of the beverage can. The positioning mechanism is operable to rotate the straw into alignment with the orifice in the can and a float for elevating the straw through the orifice in the can when liquid is present within the can and when the closure tab is deflected into the interior of the can. Thus, when a user opens the can, the straw disposed within the can is rotated into the appropriate position and accessible therethrough.

While the straw designs disclosed in the above-referenced patents remain technologically and commercially viable, certain improvements to the straw assembly have been made thereto. In this regard, the present invention provides a straw assembly having a positioning mechanism operably associated with a straw member for providing access thereto when the beverage container is opened. The present invention also relates to various structure features of the straw assembly which may be integrally formed therein and the process for forming these integral features.

Several embodiments of the present invention are disclosed. A first embodiment is disclosed which utilizes a straw having three distended segments in which structural features are formed in the straw. The first and second distended segments form a pocket for receiving and securing a positioning disk and a float thereto. A positioning disk, or alternatively a camming disk, are operably coupled to the straw assembly. Thus, the buoyancy characteristics of the straw assembly maintains the proper angular position enabling the user to manipulate the container to bring the straw member into alignment with the opening in the container. The third distended segment provides a conventional pleat structure which permits extension and retraction of the use end of the straw, thereby increasing or decreasing the overall length thereof. Alternate embodiments of the first preferred embodiment are disclosed which provide improvements to the structure and operation for various components of the present invention including a self-propelled float and a stiffness enhanced straw member.

In a second embodiment, the straw includes three distended segments in which distinct features are formed therein. More particularly, first and second distended segments provide a pillow structure which acts as an integral float lifter and obviates the need for providing a separate float element, and also are configured to retain the positioning disk onto the straw member. These pillow structures may optionally contain float pockets which further enhance the buoyancy characteristics of the straw. The third distended segment is provided to form the conventional pleat structure operable to modify the length of the straw.

A third embodiment is disclosed which is directed to a telescoping straw assembly. More particularly, the straw assembly includes an inner straw portion disposed and movable within an outer straw portion to provide adjustment in the length of the straw assembly. In addition, an annular volume of formed between the inner and outer straw portions to provide an integral float, thereby reducing the size of or eliminating the need for a float. The inner straw member further includes a pleated portion for providing addition adjustment to the length and orientation of the straw assembly.

A fourth embodiment is disclosed which is directed to a straw assembly readily adaptable for placing a straw assembly in a bottle such as a stretch blow-molded PET bottle. The straw assembly includes a straw member and a positioning mechanism slidably movable along the longitudinal axis of the straw for engaging a portion of the bottle to align the straw with the opening of the bottle. Gaseous fluid from the head space in the bottle is utilized to buoy the positioning mechanism towards the tapered end wall of the bottle near the opening.

As will be appreciated by those skilled in the art, the above-described embodiments of the present invention are readily adaptable for use in various beverage containers and provides improvements to straw assemblies utilized with a dispensing device in a beverage container.

Thus, it is an object of the present invention to provide a beverage container with the improved straw assembly that is simple in design, utilizes a minimum of material, is inexpensive to manufacture, and requires relatively inexpensive equipment to assemble and insert into the containers.

It is another object of the present invention to provide a simple and inexpensive straw assembly that is readily adaptable for use in a wide variety of beverage containers and which are configured to be utilized with containers currently in use by the industry.

Yet another object of the present invention is to provide a means for attaching a float to the straw assembly in such a way as to improve operation of the float and to ensure improved performance, safety and ease of straw removal.

It is a further object of the present invention to provide a straw assembly which includes an integrated float, thereby eliminating the need for a separate float component.

It is yet another object of the present invention to provide a straw assembly having a positioning mechanism which substantially aligns the straw within an opening formed in the bottle.

It is a further object of the present invention to provide improved materials for fabricating a drinking straw member including a photo-degradable straw member, a buoyant, cellular plastic straw member, and a buoyant straw member having a cellular plastic portion operably disposed between an inner and outer non-cellular plastic skin.

Additional objects and advantages of the present invention will become apparent from a reading of the following detailed description of the preferred embodiments which make reference to the drawings of which:

DETAILED DESCRIPTION OF THE PREFERRED EMBODIMENT

Figure 1:
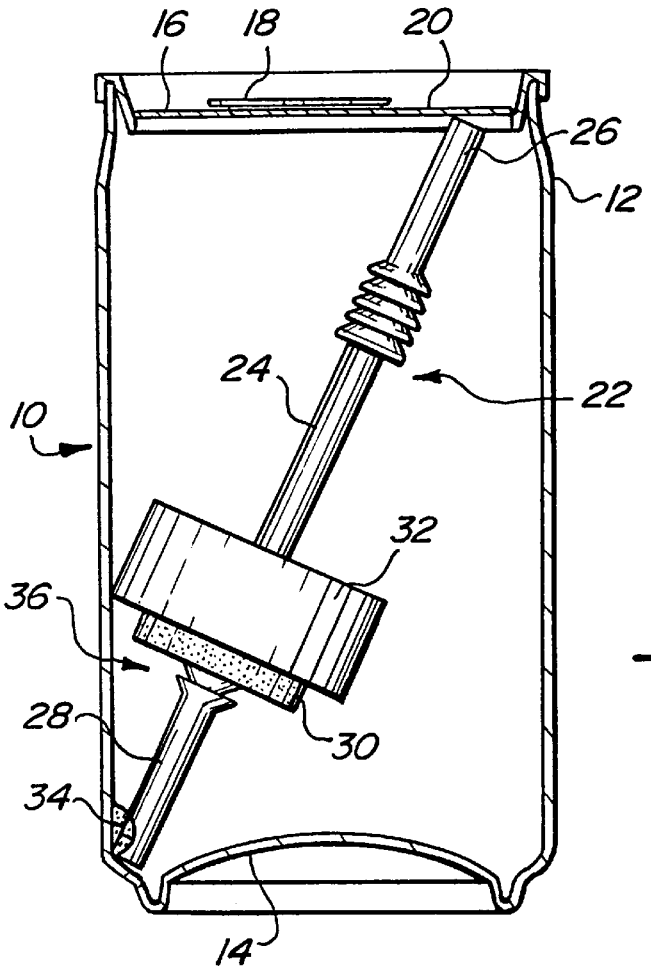
FIG. 1 is a vertical sectional view of a beverage can containing a straw assembly having a straw member, a positioning disk and a float according to a first embodiment of the present invention.

Referring to FIG. 1, a first preferred embodiment of the present invention is shown. Beverage can 10 comprises a conventional aluminum container having cylindrical body 12 with closed bottom 14 and lid 16 that is joined by a seaming operation to body 12 of can 10. Lid 16 includes lever ring 18 pivotally secured thereto and adapted to deflect closure tab 20 into the interior of can 10, thereby providing an orifice through lid 16 for gaining access to the contents contained within can 10. Closure tab 20 is formed by scoring lines in lid 16 which enable a control portion thereof to break free when lever ring 18 is actuated against closure tab 20. In addition, manipulation of ring 18 and closure tab 20 provides access to straw assembly 22 disposed within beverage can 10. While the present invention is illustrated and described in conjunction with an aluminum can, one skilled in the art will readily recognize that the present invention is equally adaptable for use with other types of beverage containers such as bottles or cartons.

Straw assembly 22 includes straw member 24 having a proximal or use end 26 and a distal end 28 opposite proximal end 26. Straw assembly 22 further includes float 30 attached near distal end 28 and weighted positioning disk 32 disposed over straw member 24 adjacent float 30. When initially disposed in can 10 prior to the filling and seaming processes, distal end 28 of straw member 24 is preferably temporarily adhered to a portion of beverage container 10, such as cylindrical body 12 adjacent bottom 14, with a small amount of soluble adhesive, such as glucose or thixotropic gel. Alternately, a small amount of concentrated syrup may be utilized for this purpose. After the filling and seaming processes are completed, adhesive bond 34 will dissolve, enabling straw member 24 to float freely within can 10. Due to the positioning of float 30 beneath positioning disk 32 on straw 24 member, the orientation of straw 24 within can 10 will remain substantially as shown in FIG. 1.

Straw member 24 further includes various structural features to position and retain float 30 and positioning disk 32 therewith. More specifically, straw member 24 includes a lower distended segment 36 and an intermediate distended segment 38 formed therein to position and retain float 30 in the appropriate axial location on straw member 24. Lower distended segment 36 includes a pair of downwardly aligned frustoconical rings which define a seating surface 40. Similarly, intermediate distended segment 38 includes a single upwardly aligned frustoconical ring. As such, straw member 24, lower distended segment 36 and distended segment 38 define a pocket 42 which captures and retains float 30 on straw member 24.

Positioning disk 32 is concentrically located over straw 24 and directly engages an upper surface 44 of float 30. More specifically, positioning disk 32 has a central aperture 46 formed therethrough. A plurality of barbs 48 are formed on a lower end wall of positioning disk 32 and extend downwardly to impale float 30, thereby securing positioning disk 32 with float 30. A plurality of inner barbs 50 are formed on the inner wall of positioning disk 32 formed by aperture 46. Inner barbs 50 function to retain float 30 with positioning disk 32 should straw member 24 be removed therefrom in a manner hereafter described. As presently preferred, positioning disk 32 is fabricated from a suitable rigid plastic such as PET, polystyrene and polyvinylchloride which are ideally of greater density than the liquid beverage in the container and which provides adequate stiffness to maintain the structural integrity of positioning disk 32.

Central aperture 52 formed in float 30 is approximately the same diameter as the outside diameter of straw member 24 and is positioned in pocket 42 by sliding float 30 axially along straw member 24. In contrast, central aperture 46 formed in positioning disk 32 has a conical cross section in which the larger diameter is approximately twice the diameter of the frustoconical rings associated with lower distended section 36, and in which the upper diameter is slightly larger than the diameter of lower distended segment 36.

As presently preferred, float 30 is constructed from a suitable cellular foam plastic, such as a foam of any suitable polyolefin or polyester and provides sufficient buoyancy force to cause straw assembly 22 to ascend through the orifice in lid 16 when liquid is present in can 10 and when closure tab 20 has been opened. Alternatively, float 30 may be molded from a suitable polypropylene, using chemical blowing agents or gas injection or a combination thereof, or a coralfoam process, all of which are known to produce formed structures having an integral skin components around the total surface of float 30. Moreover, float 30 may be round or oval, or any shape suitable to perform the functions described herein.

Figure 4:
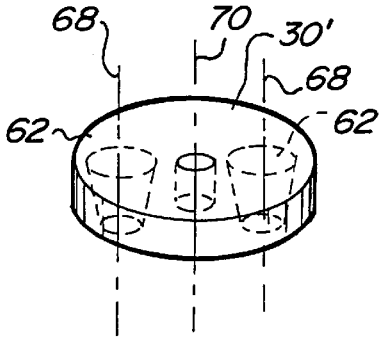
FIG. 4 is a perspective view showing a self-propelled float adaptable for use in place of the float of the straw assembly illustrated in FIGS. 1–3.
Figure 5:
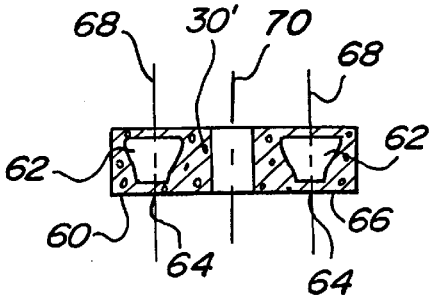
FIG. 5 is a cross-sectional view of the float illustrated in FIG. 4.

Alternatively, a self-propelled float such as that illustrated in FIGS. 4 and 5 may be incorporated into the present invention. More specifically, float 30' includes a plurality of voids 62 molded into the interior thereof. As presently preferred, voids 62 are conical or semi-conical in shape and may additionally have an orifice 64 through the bottom surface 66 of float 30'. The axis 68 of the conical void 62 may be tilted relative to the central longitudinal axis 70 of float 30' to provide desirable rotation of float 30', and thus concomitant rotation of the straw assembly associated therewith.

Figure 2:
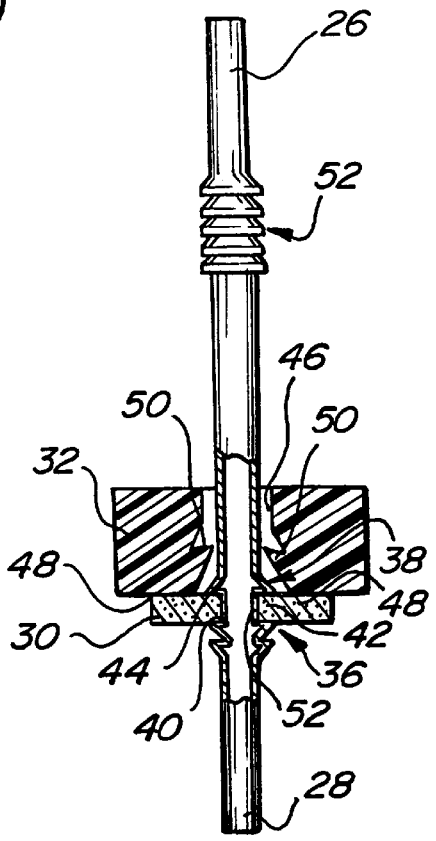
FIG. 2 is a partial cross-sectional view of the straw assembly illustrated in FIG. 1.
Figure 3:
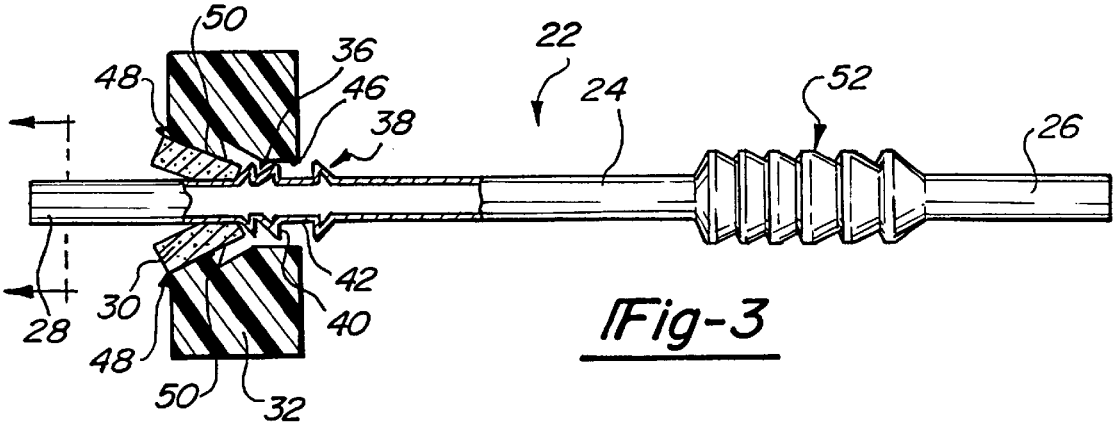
FIG. 3 is a partial cross-sectional view of the straw assembly shown in FIG. 2 in which the straw member is being removed from the positioning disk.

Once the straw assembly with float 30' is inserted, and the can is filled and closed, there will be an equilibrium of carbon dioxide ($CO_2$) pressure in the head space and the liquid, such that the voids 62 in float 30' are filled with $CO_2$ gas. Upon opening the container, the gas will escape through the micropores generated as float 30' is molded and the float counter-pressure released. Escaping gas will act as a jet, propelling the straw assembly associated with float riser 30' to the top of the container and out through an opening associated therewith. One skilled in the art will readily recognize that a single or plurality of voids 62 can be incorporated to directionally propel the straw assembly upwardly. The conical voids 62 having a tilted cone axis 68 can rotationally propel the straw assembly. This rotational propulsion can be designed to provide inertia sufficient to overcome any tendencies from the straw assembly to stall or miss the desired opening within the container. With reference now to FIGS. 1–3, straw member 24 is removable from can 10 without concern that float 30 will become dislodged from positioning disk 32, thereby interfering with the dispensing of beverage from can 10 when straw member 24 is removed. More specifically, as best seen in FIG. 3, as straw member 24 is removed from can 10, it is pulled axially through aperture 46 formed in positioning disk 32. Such relative axial movement pulls float 30 into central conical aperture 46 of positioning disk 32. Further relative axial movement of straw member 24 impales float 30 onto inner barbs 50 formed on positioning disk 32 to capture and hold float 30 with positioning disk 32. Once lower distended segment 36 clears inner barb 50 and disengages float 30, straw member 24 is free to be removed from beverage can 10. Notwithstanding the removal of straw member 24, float 30 remains impaled on inner barbs 50, thereby retaining float 30 with positioning disk 32 in a desirable manner.

Straw member 24 further includes an upper distended segment 52 formed adjacent the proximal end 26 of straw member 24. The upper distended segment 52 includes a plurality of frustoconical pleats formed in straw member 24 which permits adjustment of the length of straw 24 in a manner well known in the art. These pleats may be oriented upwardly or downwardly relative to the proximal end 26 of straw member 24.

As presently preferred, lower distended segment 36 includes a pair of frustoconical ring sections, intermediate distended segment 38 includes a single frustoconical ring section and upper distended segment 52 includes five frustoconical ring sections. However, one skilled in the art would readily recognize that the number and location of these segments can be modified without deviating from the scope of the present invention.

Figure 3C:
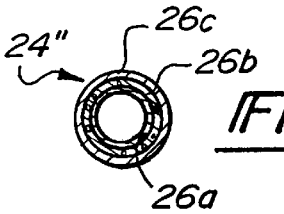
FIG. 3*c* is yet another alternate embodiment of the straw member illustrated in FIG. 3 in which the straw member has a non-cellular plastic inner and outer skin and a cellular plastic filling therebetween.
Figure 3B:
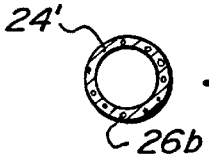
FIG. 3*b* is an alternate configuration for the straw member illustrated in FIG. 3 having a substantially homogeneous cellular plastic composition.
Figure 3A:
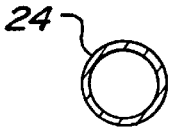
FIG. 3*a* is a cross-sectional view of the straw member illustrated in FIG. 3 showing a substantially homogeneous non-cellular plastic composition.

As presently preferred, straw member 24 is manufactured by utilizing three independently controlled heating zones, one associated with the lower, intermediate and upper distended segment, whereby a substantially straight straw is heated prior to reforming, and then passed into three independent mold zones, associated with each of the aforementioned segments to form the softened plastic. As shown in FIG. 3*a,* straw member 24 is preferably fabricated from a noncellular, thermal responsive plastic such as polypropylene.

Alternately, straw member 24 may be fabricated from a photo-degradable composition such that exposure of the straw to a particular wave length of light will expedite its photodegradation. As presently preferred, a mixture of extrusion grade ethylene carbon monoxide copolymer (ECO) containing approximately 0.2 to 5 percent carbonyl units may be mixed with an extrusion grade polypropylene resin (PP) and extruded into a straw. A useful composition for this application is approximately between 2 and 20 percent ECO copolymer with the PP and other suitable adjuvants. It is been found that a straw fabricated from this composition is satisfactorily formable and will maintain the structural integrity during the necessary secondary operations, including flexing, pleat formation, device attachment and the like without any adverse effects. However, when exposed to sunlight, a straw manufactured from the above-described composition photodegraded within approximately 90–120 days.

Other materials could also be utilized for fabricating straw member 24. For example, as illustrated in FIGS. 3*b* and 3*c,* straw member 24, and 24' respectively, could be fabricated from a homogenous cellular foam material 26*b* with or without a co-extruded outer and/or inner skin 26*c,* 26*a,* respectively, of non-cellular material, thereby providing additional buoyancy characteristics to straw assembly 22. In this alternate embodiment, a presently preferred extrudable cellular material selected from the group of ethylenic polyolefins including ethlane olefin, and most preferably ultra low density polyethlane olefin could be utilized and is readily adaptable for co-extrusion with a non-cellular material selected from the group of olefins including polyethylene, and most preferably low density polyethylene.

Figure 6:
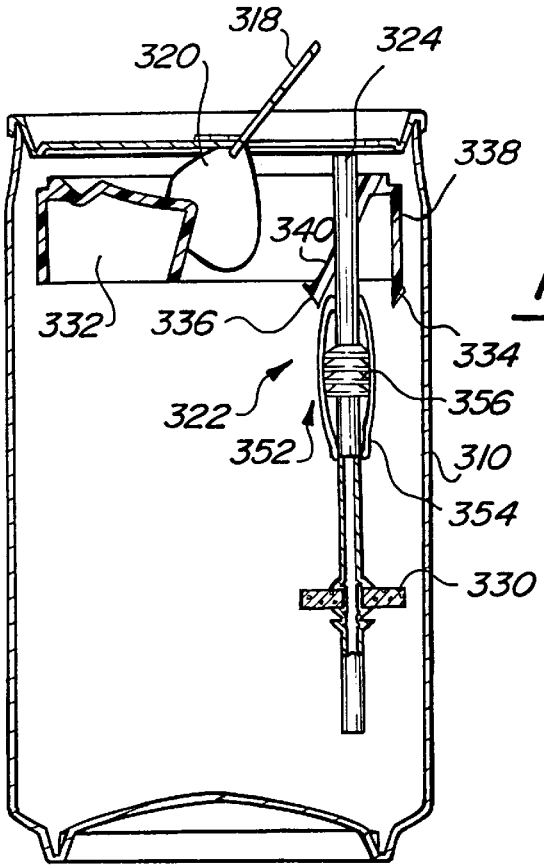
FIG. 6 is a partial cross-sectional view of a straw assembly similar to that illustrated in FIG. 1 having a straw member, a camming disk and a float.
Figure 7:
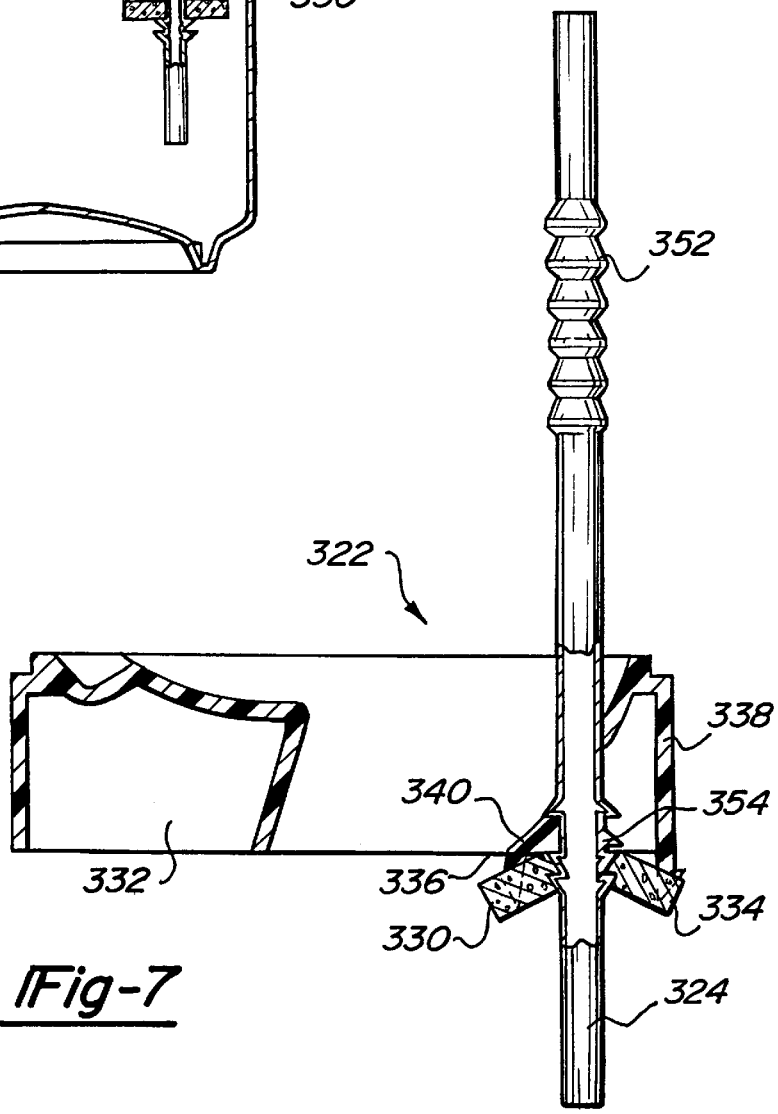
FIG. 7 is a detailed view of the straw assembly illustrated in FIG. 6 in which the straw member is being removed from the camming disk.

Referring now to FIGS. 6 and 7, a partial cross-sectional view of a straw assembly similar to that illustrated in FIGS. 1–3 is shown with cam disk 332 substituted for positioning disk 32. FIG. 6 illustrates beverage can 310 and straw assembly 322 after lever ring 318 has pushed closure tab 320 into the interior of beverage can 310 to provide an opening therein. Straw assembly 322 includes straw member 324, float 330 and camming disk 332. Camming disk 332 is manufactured from a material which will float within the liquid contained inside beverage container 310 and thus will position itself at the top thereof. Camming disk 332 is designed such that it rotates to appropriately position straw assembly 322 when beverage container 310 is opened. A presently preferred embodiment of camming disk 332 is illustrated and disclosed in U.S. application Ser. No. 08/856,838 entitled "Beverage Container With Self-Contained Drinking Straw", which is commonly owned by the assignee of the present invention and the disclosure of which is expressly incorporated by reference herein.

Camming disk 332 further includes a plurality of barbs 334, 336 formed on a portion of outer wall portion 338, 340 respectively. Barbs 334, 336 extend downwardly to impale float 330 as straw member 324 is extracted from camming disk 332, thereby securing camming disk 332 with float 330.

With continued reference to FIG. 6, for a standard 12-ounce beverage can, straw member 324 should have a length of approximately 6.1 inches to provide an ergonomically pleasing delivery system for beverage therefrom. Straw assembly 322 used in conjunction with camming disk 332 is preferably approximately 3.7 inches long. The length difference of approximately 2.4 inches is provided by flexible pleats 352. Thus, approximately 48–56 pleats are required to provide this extension. Pleats 352, when collapsed properly, form a compact structure of some rigidity. However, due to the large number of pleats required, the rigidity may be less than the original straw and may be less than is required for proper functioning of straw assembly 324. Thus, it is desirable to provide enhanced structural rigidity to the straw assembly 322 to ensure the proper functioning of the positioning device.

In this regard, pleated portion 352 is surrounded by sleeve 354 which is a very thin shrink wrap of a low density, linear low density, or ultra low density polyethylene. Sleeve 354 is shrunk around the body of straw member 324 above and below pleated portion 352, but most especially at the end adjacent float 330. As presently preferred, sleeve 354 will hold snugly to the body of straw member 324, above and below pleated portion 352, and conform to pleated structure 352. Thus, sleeve 354 will add inherent rigidity to straw member 324. Moreover, sleeve 354 will provide a smooth surface to interact with the aperture formed through camming disk 332 thereby allowing smooth passage of straw assembly 322 through cam disk 332 during operation. Once straw assembly 322 is appropriately positioned for consumption of a beverage included in container 310, sleeve 354 can be removed such that straw member 324 can be further extended to its final length.

Straw member 324, by virtue of the pleating, has a volume 356 between each pleat, which if not covered by sleeve 354 will be in contact with the liquid. Thus, the inclusion of sleeve 354 creates volume 356 between sleeve 352 and pleated portion 352 which can be occupied by a gaseous substance. The volumetric considerations are such that the specific gravity of straw member 324 is lowered due to the entrapped gas space, enhancing the buoyancy of the straw member 324 and minimizing the size of or eliminating the need for float 330.

Additionally, if the liquid within beverage container 310 is a carbonated soft drink or a similar beverage enhanced by the addition of a gaseous substance, the gas in the beverage will permeate through sleeve 354 into the gas space between pleated portion 352 and sleeve 354 and achieve gaseous pressure equilibrium with its surrounding. When beverage container 310 is open, the head space gas pressure is relieved and the gas in the pleated area will expand to achieve equilibrium pressure with the head space. This volume expansion will cause sleeve 354 to increase to a size to accommodate the pressure equilibrium, thereby providing additional buoyancy and further reducing the specific gravity of straw assembly 322. Moreover, the dilated sleeve will limit the travel of straw 324 through camming disk 332 to prevent premature ejection of straw member 324.

When straw member 324 is extended, pleated portion 352 will cooperate to increase the length and locally decrease the diameter of straw member 324 such that sleeve 354 is locally oversized, thus permitting straw member 324 to be drawn through the aperture formed in camming disk 332. As further extension of straw member 324 proceeds, sleeve 354 will bunch around the base thereof and provide both a float device and a means for retaining the straw within the container until removal is desired.

When no longer needed, straw member 324 is withdrawn completely through camming disk 332 and removed. Removal of straw member 324 causes float 330 to be impaled onto barbs 336, 338. In addition, sleeve 354 is trapped between camming disk 332 and float 330 such that both components remain with camming disk 332 and are not released within beverage container 310.

Figure 8:
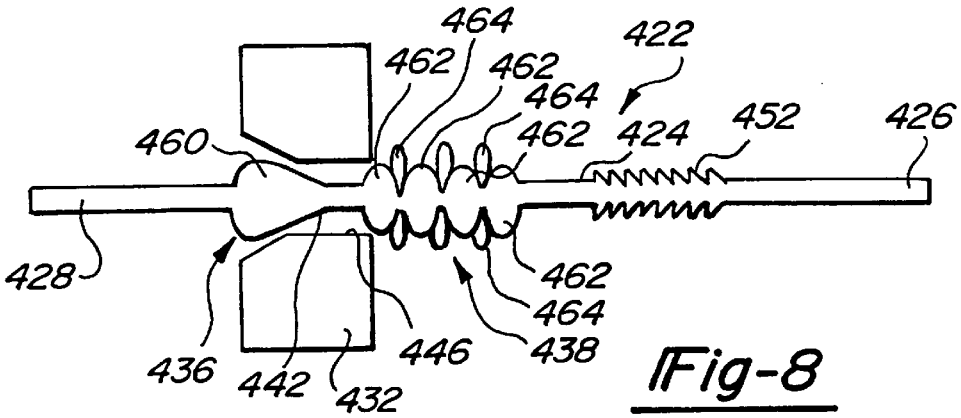
FIG. 8 is a partial cross-sectional view of a straw assembly in accordance with a second preferred embodiment of the present invention.
Figure 9:
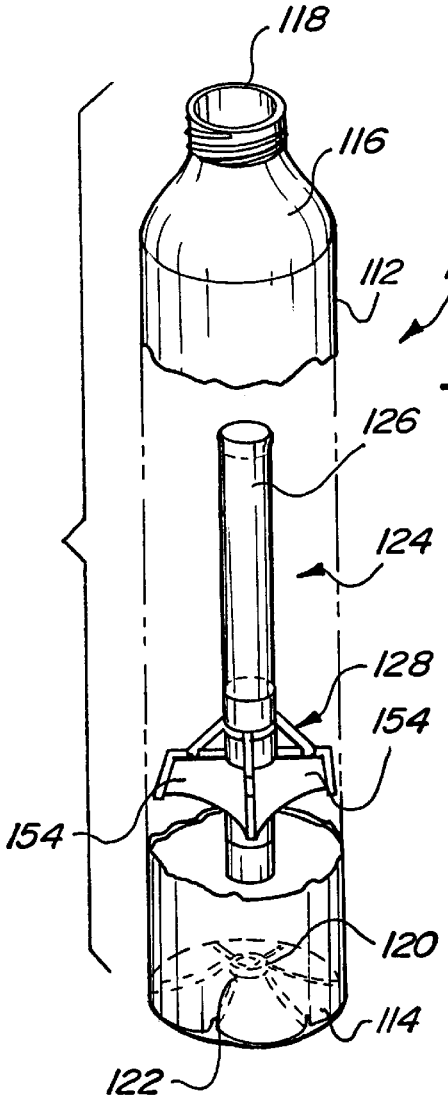
FIG. 9 is an exploded perspective view of a straw assembly in accordance with the third embodiment of the present invention.

Referring now to FIG. 8, a second embodiment of the present invention is illustrated in which certain structural features are integrated into the straw assembly, thereby eliminating the need for separate components. More specifically, straw member 424 includes a proximal end 426 and a distal end 428, as well as lower distended segment 436, intermediate distended segment 438 and upper distended segment 452 formed therein. As presently preferred, lower distended segment 436 includes a bulbous conical volume formed in the side wall of straw member 424. Similarly, intermediate distended segment 438 includes a plurality of bulbous spherical volumes formed in the side wall and axially arranged along straw member 424. One skilled in the art should readily recognize that while these geometric configurations are presently preferred, other geometric configurations such as bulbous elliptical volumes could be utilized without deviating from the scope of the present invention.

Straw member 424 differs from straw member 24 associated with the first preferred embodiment in that lower and intermediate distended segments 436, 438 functionally replace float 30 associated with the first preferred embodiment. More specifically, pocket 442 is formed between lower distended segment 436 and intermediate distended segment 438 which is adapted to receive positioning disk 432. More specifically, lower distended segment 436 is adapted to engage the inner wall formed by central aperture 446 of positioning disk 432. Intermediate distended segment 438 functions to hold positioning disk 432 in its appropriate axial position.

Similarly, lower distended segment 436 and intermediate distended segment 438 are configured to act as floats and will enhance the buoyancy of the straw assembly 422. Optionally, intermediate distended segment 438 may include float pockets 464 formed therebetween by the compressive forces on the straw after molding to initiate float pocket 464. In this manner, the material utilized to form float pockets 464 are heated to a temperature higher than the temperature associated with the other zones for lower distended section 436" and upper distended section 452".

With reference now to FIGS. 9–12, a third preferred embodiment of the present invention is illustrated. Beverage container 110 comprises a conventional stretch blow-molded PET bottle having a generally cylindrical side wall 112 with a closed bottom 114 and a tapered end wall portion 116 terminating at opening 118. In this regard, container 110 is similar to that conventionally used for distribution of carbonated beverages and the like with a slight modification to the bottom portion thereof. More specifically, bottom portion 114 has indentation 120 formed in a center thereof. Indentation 120 is expeditiously made by a stretch rod used during the blowing process of bottle 110. As presently preferred, mooring stud 122 is disposed within indentation 120 and provides an attachment location for self-dispensing straw assembly 124 in a manner hereafter described. One skilled in the art will readily recognize that straw assembly 124 may be directly inserted into indentation 120 for attachment with bottle 110.

Straw assembly 124 includes straw member 126 and positioning mechanism 128 slidably positionable along the longitudinal axis of straw member 126 to appropriately position straw assembly 124 relative to opening 118 of bottle 110. Positioning mechanism 128 includes lower collar 130 having a plurality of legs 132 extending radially outwardly therefrom, and upper collar 134 having a plurality of connecting members 136 extending radially outwardly therefrom. Each connecting member 136 is operably connected to an associated leg 132. Lower and upper collars 130, 134 are concentrically disposed over straw member 126 and freely reciprocate along its longitudinal axis.

Each of the plurality of legs 132 extending from lower collar 130 includes an inner portion 138 and an outer portion 144. Inner portion 138 is secured to lower collar 130 at inner hinge point 140 and extends radially outwardly therefrom to terminate at mid hinge point 142. Outer portion 144 is operably coupled to inner portion 138 at mid hinge point 142. Connecting member 136 is secured at upper hinge point 146 to upper collar 134 and is operably coupled to inner portion 138 at lower hinge point 148. As presently preferred, legs 132 and connecting member 136 are fabricated from a suitable plastic, such as polypropylene, and hinge points 140, 142, 146 and 148 are living hinges defined between the respective components of positioning mechanism 128.

Positioning mechanism 128 defines a kinematic linkage, the geometry of which is defined by the position of lower collar 130 relative to upper collar 134. As presently preferred, positioning mechanism 128 includes a plurality of legs radially extending therefrom. As presently illustrated in the figures, positioning mechanism 128 includes four leg assemblies 132. However, the number of legs should properly be determined by the size of the straw assembly 124 and the volume of the contents within bottle 110. It is presently believed that positioning mechanism 128 must contain at least three legs to provide the proper support for parachute device 152. Similarly, it is believed that the maximum number of legs is determined by providing parachute device 152 with sufficient surface area to enhance the buoyancy of positioning mechanism 128. As presently preferred, the number of legs associated with positioning mechanism 128 is between approximately three and eight depending on the size and contents of bottle 110.

Membrane 154 is attached between each of the plurality of legs 132 extending from lower collar 130 and define a parachute-type device which will capture gaseous fluid trapped within bottle 110, thereby providing additional buoyancy to urge positioning mechanism 128 upwardly therein in a manner hereafter described.

Straw assembly 124 further includes mooring collar 152 disposed on the distal end 150 of straw member 126. Mooring collar 152 cooperates with mooring stud 122 for temporarily securing straw assembly 124 in the bottom of bottle 110. As presently preferred, mooring collar 152 is a micro-foamed component which maintains engagement with mooring stud 122 when dry. However, once the foam component is saturated with liquid, it expands and properly disengages mooring stud 122 for operably freeing straw assembly 124 from bottle 110.

Figure 10:
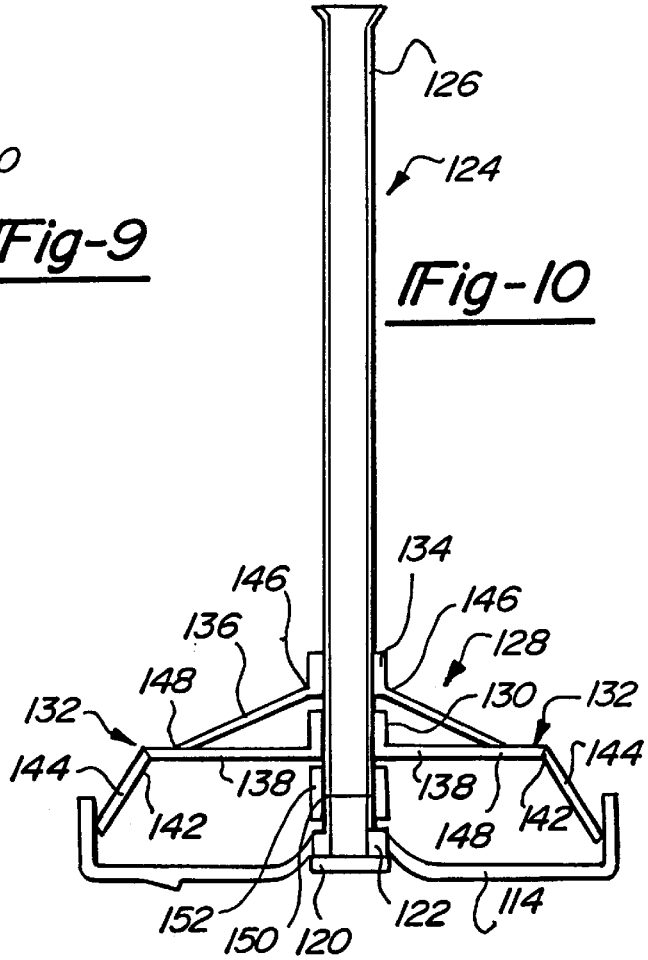
FIG. 10 is a partial cross-sectional view of the straw assembly illustrated in FIG. 9 in which the positioning mechanism is located in its moored position.
Figure 11:
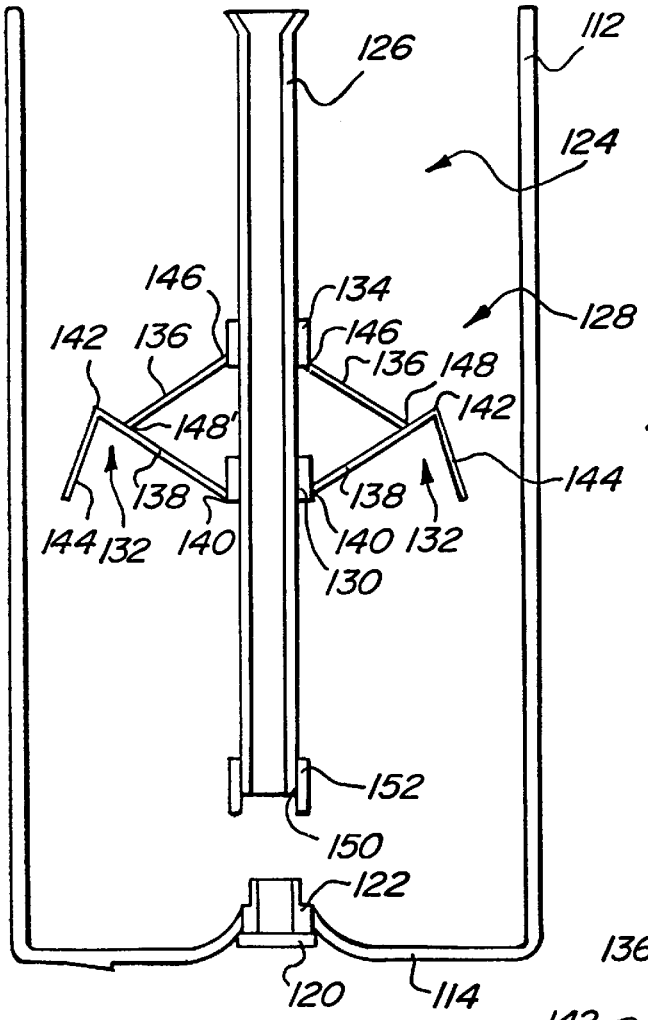
FIG. 11 is a partial cross-sectional view of the straw assembly illustrated in FIG. 9 in which the straw assembly is released from its moored position and in which the positioning mechanism is traversing toward its engaged position at the top of the bottle.
Figure 12:
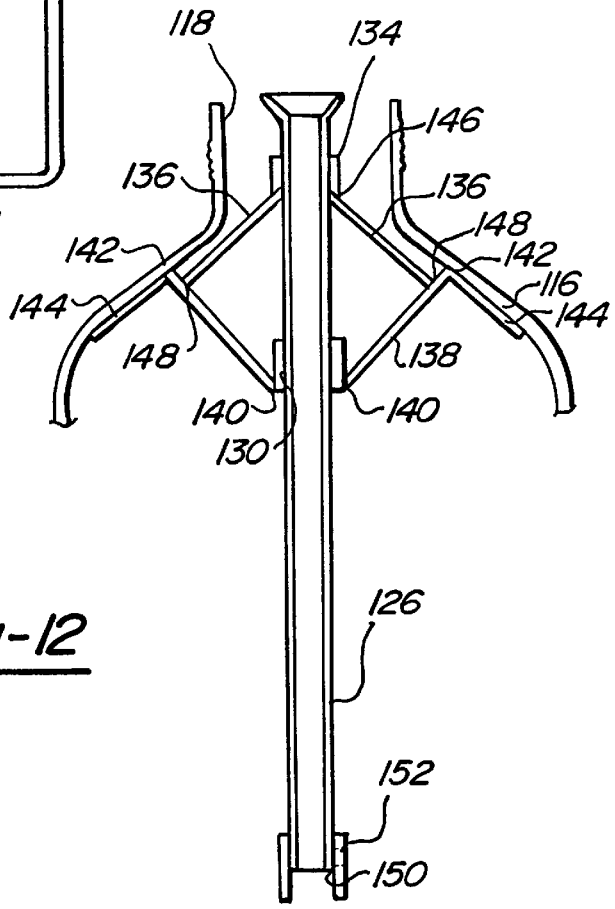
FIG. 12 is a partial cross-sectional view of the straw assembly illustrated in FIG. 9 in which the positioning mechanism is engaged at the tapered end wall of the bottle in an,aligned position with the opening thereof.

With continued reference to FIGS. 10–12, the operation of the third embodiment of the present invention will now be described. Prior to filling of bottle 110, straw assembly 124 is inserted into bottle 110 using standard high-speed insertion techniques known to one skilled in the art. The foldable nature of positioning mechanism 128 enables it to be folded up into a compact nature and inserted into bottle 110 through opening 118. Once a straw assembly 124 is inserted into bottle 110, mooring collar 152 is urged onto mooring stud 122 for temporarily securing straw assembly 124 onto bottom 114. Such insertion now makes it possible for bottle 110 to be filled with the appropriate product using standard filling practices, since straw assembly 124 is well below opening 118.

During the filling operation, fluid agitation will loosen and extend legs 132 of positioning mechanism 128 so that they extend past the diameter of opening 118. Furthermore, during the filling operation, a certain amount of the liquid is absorbed by mooring collar 152 causing it to expand and release straw assembly 124 from mooring stud 122 at the bottom of bottle 110. The rate of absorption of mooring collar 152 is designed such that it requires a longer time period to release from mooring stud 122 than the time required for filling and capping of bottle 110.

After straw assembly 124 has been released from mooring stud 122, positioning mechanism 128 begins to float within the liquid contained in bottle 110 due to the fact that it has a lighter specific gravity than the fluid contained therein. At this point, outer portions 144 are in proximity of cylindrical side wall 112 and straw assembly 124 is in an approximately neutrally buoyant condition.

Bottle 110 is subsequently inverted during subsequent handling procedures causing the gas associated with head space in bottle 110 to migrate past positioning mechanism 128 toward bottom 114 thus inflating membrane 154. More specifically, when bottle 110 is returned to its upright position, membrane 154 is filled with head space gas (and re-pressurized from dissolved gas if the beverage is carbonated). As such, membrane 154 provides additional buoyancy to positioning mechanism 128 causing it to move upwardly as best illustrated in FIG. 11 until it engages tapered end wall 116 of bottle 110 as best shown in FIG. 12. In this position, outer portions 144 engage tapered end wall 116 and appropriately position straw member 126 within opening 118 of bottle 110. The head space gas trapped by membrane 154 maintains positioning mechanism 128 in the appropriate position. In addition, outer portions 144 may be fabricated from a sufficiently flexible material such that they act like suction cups adhering and maintaining positioning mechanism 128 in its proper position for ultimate use.

Figure 13:
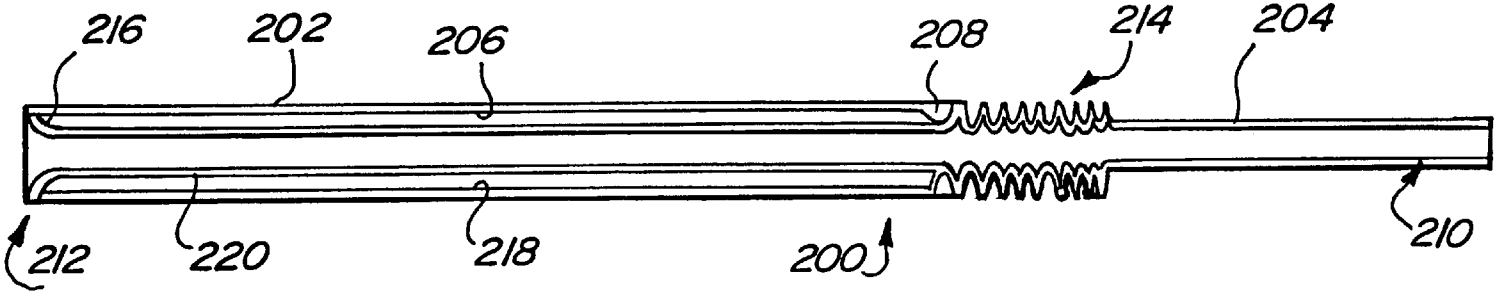
FIG. 13 is a cross-sectional view of a telescoping straw assembly in accordance with a fourth preferred embodiment of the present invention.
Figure 14:
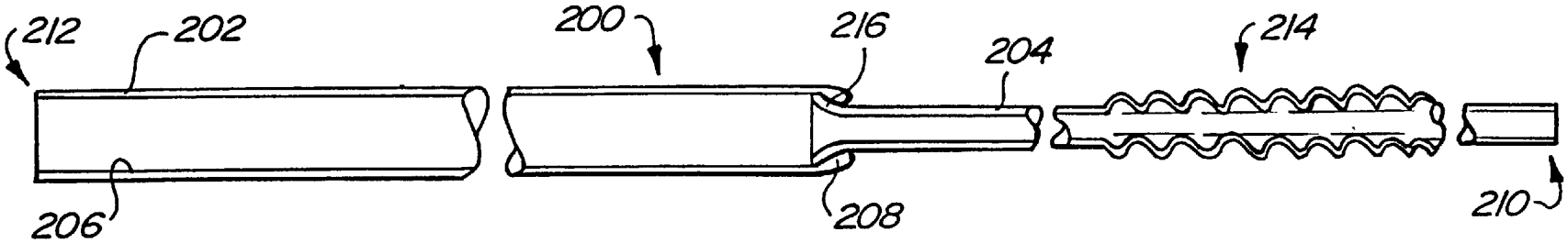
FIG. 14 is a cross-sectional view of the straw assembly shown in FIG. 13 in an extended condition.

Referring now to FIG. 13 and 14, a straw assembly having an extendable length straw member for use in an aluminum can or other suitable container which includes telescoping portion and a flexible pleated portion therein. In addition, the straw assembly provides an intermediate volume between an inner and outer straw portion which acts as an integral float when the straw assembly is collapsed and disposed within a filled container, and especially when the beverage is a carbonated soft drink. Thus, the straw assembly is readily adaptable for use with a wide variety of devices for dispensing a straw assembly from within a beverage container such as those disclosed herein, as well as those referenced and expressly incorporated herein.

Straw assembly 200 includes outer straw portion 202 and inner straw portion 204 partially disposed within outer straw portion 202. More specifically, outer straw portion 202 is generally cylindrical having an inner wall 206 formed thereon. A seal member 208 is circumferentially disposed about an end of outer portion 202 closest to the proximal end 210 of straw assembly 200. Outer portion 202 terminates at distal end 212.

Inner portion 204 includes a pleated portion 214 which enables the length of inner portion 204 to be adjusted, as well as permitting the distal end 210 of straw assembly 200 to be angularly positioned in a manner well known in the art. Inner portion 204 further includes a flared portion 216 formed on an end opposite distal end 210. As best seen in FIG. 13, flared portion 216 engages distal portion 212 of outer portion 202 to sealingly engage with inner wall 206. Annular volume 218 is formed between inner wall 206 of outer portion 202 and outer wall 220 of inner portion 204 when straw assembly 200 is in a collapsed state. Flared portion 216 of inner portion 204 sealingly engages the distal end 212 of straw assembly 200. Similarly, seal 208 of outer portion 202 engages outer wall 220 and pleated portion 214 of inner portion 204. In this manner, annular volume 218 is sealed so as to act as an integral float when straw assembly 200 is disposed within the beverage, especially when the beverage is a carbonated soft drink. More specifically, annular volume 218 may be pressurized with carbon dioxide gas from the beverage as part of the head space pressurization equilibrium.

With reference now to FIG. 14, straw assembly 200 may be extended to provide a straw member of desirable length. More specifically, inner portion 204 is longitudinally positioned relative to outer portion 202 such that flared portion 216 is positioned directly adjacent seal 208 formed on outer portion 202, thereby providing a fluid tight drinking conduit. In addition, pleated portion 214 may be extended to adjust the length of straw assembly 200 to a desired length.

As presently preferred, straw assembly 200 has an overall length of approximately 3.7 inches when collapsed and an overall length of approximately 6.125 inches when extended. Furthermore, the outer diameter of pleated portion 214 is approximately equal to the outer diameter of outer portion 202 such that it can be readily accommodated into various known dispensing devices such as those previously described herein.

While the present invention has been described and illustrated above with particular reference to the presently preferred embodiments, one skilled in the art should readily recognize that the invention is subject to additional variations and modifications without departing from the spirit of the invention as set forth in the appended claims. Moreover, each of the preferred embodiments includes various structures and/or functional features alone and in combination. One skilled in the art should recognize that these structures and functions can be utilized alone or in combination as deemed necessary for a given application.

What is claimed is:

1. A straw assembly having an extendable length, said straw assembly comprising:

a straw member having a wall portion and a plurality of pleats formed in said wall portion, said pleated portion permitting adjustment of the length of said straw member; and a sleeve disposed over and conforming to said plurality of pleats to increase the rigidity of said straw member, said sleeve being a thin shrink wrap plastic.

2. The straw assembly according to claim 1, wherein said straw assembly comprise:

a first distended segment unitary with said wall portion;

a second distended segment unitary with said wall portion, said wall portion and said first and second distended segments defining a pocket; and a positioning member having an aperture therethrough for receiving said straw member such that said positioning member is removably secured in said pocket adjacent said first and second distended segments.

3. The straw assembly of claim 1, wherein each of said plurality of pleats is a frustoconical ring section.

4. The straw assembly of claim 1, wherein said straw member is fabricated from an extrudable, photo-degradable plastic material.

5. The straw assembly of claim 1, wherein said straw member is fabricated from an extrudable cellular foam plastic.

6. The straw assembly of claim 1, wherein said straw member comprises:

an extruded cellular foam plastic portion having an inner surface and an outer surface; and an extruded non-cellular plastic disposed on at least one of said inner surface and said outer surface.

7. A straw assembly having an extendable length, said straw assembly comprising:

a straw member having a wall portion and a plurality of pleats formed in said wall portion, said pleated portion permitting adjustment of the length of said straw member; and a sleeve disposed over and conforming to said plurality of pleats, said sleeve covering substantially all of said plurality of pleats to increase the rigidity of said straw member, said sleeve being a thin shrink wrap plastic.

8. The straw assembly according to claim 7, wherein said straw assembly comprise:

a first distended segment unitary with said wall portion;

a second distended segment unitary with said wall portion, said wall portion and said first and second distended segments defining a pocket; and a positioning member having an aperture therethrough for receiving said straw member such that said positioning member is removably secured in said pocket adjacent said first and second distended segments.

9. The straw assembly of claim 8, wherein said positioning member is a cellular foam disk.

10. The straw assembly of claim 7, wherein each of said plurality of pleats is a frustoconical ring section.

11. The straw assembly of claim 7, wherein said straw member is fabricated from an extrudable, photo-degradable plastic material.

12. The straw assembly of claim 11, wherein said photo-degradable plastic material comprises a combination of polypropylene and ethylene carbon monoxide copolymer.

13. The straw assembly of claim 12, wherein said ethylene carbon monoxide copolymer contains approximately 0.2–5.0 percent carbonyl units.

14. The straw assembly of claim 12, wherein said photo-degradable plastic comprises two (2) to twenty (20) percent ethylene carbon monoxide copolymer.

15. The straw assembly of claim 7, wherein said straw member is fabricated from an extrudable cellular foam plastic.

16. The straw assembly of claim 15, wherein said extrudable cellular foam plastic is selected from the group of ethylinic olefins.

17. The straw assembly claim 15, wherein said extrudable cellular foam plastic comprises ultra-low density polyethylene.

18. The straw assembly of claim 7, wherein said straw member comprises:

an extruded cellular foam plastic portion having an inner surface and an outer surface; and an extruded non-cellular plastic disposed on at least one of said inner surface and said outer surface.

19. The straw assembly of claim 18, wherein said straw member further comprises a non-cellular plastic disposed on said inner surface and said outer surface.

* * * * *